US009613767B2

(12) United States Patent
Connell

(10) Patent No.: US 9,613,767 B2
(45) Date of Patent: Apr. 4, 2017

(54) ALTERNATING CURRENT SWITCH CONTACTOR

(71) Applicant: Johnson Electric S.A., Murten (CH)

(72) Inventor: Richard Anthony Connell, Cambridge (GB)

(73) Assignee: Johnson Electric S.A., Murten (CH)

( * ) Notice: Subject to any disclaimer, the term of this patent is extended or adjusted under 35 U.S.C. 154(b) by 0 days.

(21) Appl. No.: 14/554,379

(22) Filed: Nov. 26, 2014

(65) Prior Publication Data

US 2015/0145620 A1 May 28, 2015

(30) Foreign Application Priority Data

Nov. 26, 2013 (GB) ..... 1320859.0
Feb. 7, 2014 (GB) ..... 1402102.6

(51) Int. Cl.

| | |
|---|---|
| ***H01H 7/16*** | (2006.01) |
| ***H01H 47/22*** | (2006.01) |
| ***H01H 50/44*** | (2006.01) |
| ***H01H 1/50*** | (2006.01) |
| ***H01H 9/30*** | (2006.01) |

(Continued)

(52) U.S. Cl.

CPC ..... *H01H 7/16* (2013.01); *H01H 1/50* (2013.01); *H01H 1/54* (2013.01); *H01H 3/28* (2013.01); *H01H 9/30* (2013.01); *H01H 9/56* (2013.01); *H01H 47/02* (2013.01); *H01H 47/22* (2013.01); *H01H 47/223* (2013.01); *H01H 50/44* (2013.01); *H01H 50/24* (2013.01); *H01H 50/54* (2013.01); *H01H 51/2245* (2013.01); *H01H 51/2272* (2013.01); *H01H 2009/307* (2013.01); *H01H 2051/2218* (2013.01)

(58) Field of Classification Search

CPC H01H 50/44; H01H 7/16; H01H 9/30; H01H 9/28; H01H 9/56; H01H 47/02; H01H 47/223; H01H 47/22; H01H 1/50; H01H 51/2272; H01H 2009/307; H01H 50/24; H01H 51/2245; H01H 2051/2218

USPC ..... 335/63, 135, 213, 250, 256, 266

See application file for complete search history.

(56) References Cited

U.S. PATENT DOCUMENTS

| | | | |
|---|---|---|---|
| 3,188,527 | A | 6/1965 | Luce |
| 3,447,041 | A | 5/1969 | Sandstrom |

(Continued)

FOREIGN PATENT DOCUMENTS

| | | |
|---|---|---|
| EP | 2 141 723 A2 | 1/2010 |
| GB | 2249892 | 5/1992 |

(Continued)

*Primary Examiner* — Bernard Rojas

(74) *Attorney, Agent, or Firm* — Muncy, Geissler, Olds & Lowe, P.C.

(57) ABSTRACT

An electrical contactor is provided comprising a first terminal having a fixed member with at least one fixed electrical contact; a second terminal; at least one electrically-conductive movable arm in electrical communication with the second terminal and having a movable electrical contact thereon; and an AC dual-coil actuator having a first drive coil drivable to open and close the movable and fixed electrical contacts, and a second non-drive coil feedback connected to induce a reverse flux to temper and stabilize a net flux, thereby enabling control of a delay time of the opening and closing electrical contacts so as to be at or adjacent to a zero-crossing of an associated AC load current.

20 Claims, 5 Drawing Sheets

(51) Int. Cl.

| | |
|---|---|
| ***H01H 3/28*** | (2006.01) |
| ***H01H 9/56*** | (2006.01) |
| ***H01H 47/02*** | (2006.01) |
| ***H01H 1/54*** | (2006.01) |
| *H01H 50/24* | (2006.01) |
| *H01H 51/22* | (2006.01) |
| *H01H 50/54* | (2006.01) |

(56) References Cited

U.S. PATENT DOCUMENTS

| | | | | | |
|---|---|---|---|---|---|
| 3,503,022 | A | | 3/1970 | Burdett | |
| 4,486,728 | A | * | 12/1984 | Hastings et al. | 335/256 |
| 5,267,120 | A | * | 11/1993 | Graff et al. | 361/185 |
| 5,583,471 | A | | 12/1996 | Weiser et al. | |
| 5,631,614 | A | * | 5/1997 | Goodman et al. | 335/177 |
| 5,740,005 | A | | 4/1998 | Chen et al. | |
| 6,292,075 | B1 | | 9/2001 | Connell et al. | |
| 7,064,638 | B1 | * | 6/2006 | Muramatsu | 335/132 |

FOREIGN PATENT DOCUMENTS

| | | |
|---|---|---|
| GB | 2299896 | 10/1996 |
| GB | 2374218 | 10/2002 |
| GB | 2418780 | 4/2006 |

* cited by examiner

ALTERNATING CURRENT SWITCH CONTACTOR

CROSS REFERENCE TO RELATED APPLICATIONS

This non-provisional patent application claims priority under 35 U.S.C. §119(a) from Patent Application No. GB1402102.6 filed in The United Kingdom on Feb. 7, 2014, and from Patent Application No. GB1320859.0 filed in The United Kingdom on Nov. 26, 2013, the entire contents of which are hereby incorporated by reference.

FIELD OF THE INVENTION

The present invention relates to an electrical contactor, particularly but not necessarily exclusively for moderate AC switching contactors employed in modern electricity meters, so-called 'smart meters', for performing a load-disconnect function at normal domestic supply mains voltages, typically being 100 V AC to 250 V AC.

BACKGROUND OF THE INVENTION

The invention may also relate to an electrical contactor of a moderate, preferably alternating, current switch which may be subjected to a short-circuit fault condition requiring the contacts to not weld. In this welded-contact fault condition, un-metered electricity is supplied. This can lead to a life-threatening electrical shock hazard, if the load connection that is thought to be disconnected is still live at 230 V AC. Furthermore, the present invention relates to an electrical contactor and/or methods which reduce contact erosion, arcing and/or tack welding.

Additionally, it is a requirement that the opening and closing timing of the electrical contacts in such a moderate-current switch should be more precisely controlled to reduce or prevent arcing damage thereby increasing their operational life.

The term 'moderate' is intended to mean less than or equal to 120 Amps.

It is known that many electrical contactors are capable of switching nominal current at, for example, 100 Amps, for a large number of switching load cycles. The switch contacts utilize a suitable silver-alloy which prevents tack-welding. The switch arm carrying the movable contact must be configured to be easily actuated for the disconnect function, with minimal self-heating at the nominal currents concerned.

Most meter specifications stipulate satisfactory nominal-current switching through the operational life of the device without the contacts welding. However, it is also required that, at moderate short-circuit fault conditions, the contacts must not weld and must open on the next actuator-driven pulse drive. At much higher related dead-short fault conditions, it is stipulated that the switch contacts may weld safely. In other words, the movable contact set must remain intact, and must not explode or emit any dangerous molten material during the dead-short duration, until protective fuses rupture or circuit breakers drop-out and disconnect the Live mains supply to the load. This short-circuit duration is usually for only one half-cycle of the mains supply, but in certain territories it is required that this short-circuit duration can be as long as four full cycles.

In Europe, and most other countries, the dominant meter-disconnect supply is single-phase 230 V AC at 100 Amps, and more recently 120 Amps, in compliance with the IEC 62055-31 specification. Technical safety aspects are also covered by other related specifications such as UL 508, ANSI C37.90.1, IEC 68-2-6, IEC 68-2-27, IEC 801.3.

There are many moderate-current meter-disconnect contactors known that purport to satisfy the IEC specification requirements, including withstanding short-circuit faults and nominal current through the operational life of the device. The limiting parameters may also relate to a particular country, wherein the AC supply may be single-phase with a nominal current in a range from 40 to 60 Amps at the low end, and up to 100 Amps or more recently to a maximum of 120 Amps. For these metering applications, the basic disconnect requirement is for a compact and robust electrical contactor which can be easily incorporated into a relevant meter housing.

In the context of the IEC 62055-31 specification, the situation is more complex. Meters are configured and designated for one of several Utilization Categories (UC) representing a level of robustness regarding the short-circuit fault-level withstand, as determined by tests carried out for qualification or approval. These fault-levels are independent of the nominal current rating of the meter.

Acting as an actuator, there will typically be an armature or plunger which is driven by a solenoid which controls the opening and closing of the contacts. The solenoid will have two coils, each coil being driven separately and each coil being configured to provide opposing motive forces to the moveable armature or plunger.

Present arrangements of solenoid are arranged so as to close the contacts on the pull motion of the plunger, in other words, on retraction of the plunger into the core of the solenoid, and opening the contacts on the push motion. The pull motion is generally much stronger that the push motion in such an arrangement, leading to an undesirable imbalance.

The present invention seeks to provide solutions to the afore-mentioned problems.

SUMMARY OF THE INVENTION

Accordingly, in one aspect thereof, the present invention provides an electrical contactor comprising a first terminal having a fixed member with at least one fixed electrical contact; a second terminal; at least one electrically-conductive movable arm in electrical communication with the second terminal and having a movable electrical contact thereon; and an AC dual-coil actuator having a first drive coil drivable to open and close the movable and fixed electrical contacts, and a second non-drive coil feedback connected to induce a reverse flux to temper and stabilize a net flux, thereby enabling control of a delay time of the opening and closing of the electrical contacts so as to be at or adjacent to a zero-crossing of an associated AC load current.

Preferably, the driving of the first drive coil induces a reverse flux through feedback connection in the second non-drive coil to temper and stabilize a net flux, thereby controlling a delay time of the opening and closing of the first and second electrical contacts.

The addition of the second non-drive coil being feedback connected so as to induce a reverse flux to temper and stabilize a net flux also beneficially reduces the likelihood of contact bounce, and allows the delay time of opening and closing of the contacts to be controlled so as to coincide or substantially coincide with a zero-crossing of an associated AC load current. Doing so reduces damaging contact erosion energy which can be discharged during switching of the contacts, advantageously extending the lifetime of the contacts.

Preferably, the AC dual-coil actuator is a magnet-latching solenoid actuator, the solenoid actuator including a plunger. The magnet-latching solenoid may more preferably be reverse driven. There may preferably be provided at least one biasing spring for biasing the plunger to a contacts closed position.

A magnet-latching solenoid actuator has the advantage of opening the contacts on the pull motion of the plunger, rather than the push. This means that the stronger motion, the pull, is provided when a greater force may be required, for instance, if the contacts have tack welded.

There is preferably further provided a driving circuit in electrical communication with at least the first drive coil of the AC dual-coil actuator. The driving circuit may preferably supply a drive pulse to the first drive coil having a half-cycle waveform profile, or may more preferably provide a drive pulse to the first drive coil having a quarter-cycle waveform profile.

Truncating the waveform of the driving pulse allows the opening and closing of the contacts to more closely coincide with a zero-crossing point of the AC load waveform, diminishing the possible contact erosion energy. The half-cycle pulse may be used for this purpose, but a quarter-cycle pulse is more preferable, since the switching of the contacts can never occur prior to the peak of the associated load current. As such, the deleterious contact erosion energy is further limited.

According to a second aspect of the invention, there is provided a two-pole electrical contactor comprising: two pairs of feed and outlet terminals, each outlet terminal being connected to a pair of contacts on opposite faces of an electrically-conductive first member; two pairs of moveable arms, each pair of moveable arms being clamped at one end to a feed terminal, each arm carrying a moveable contact at a distal end of the arm from the feed terminal, the moveable arms being arranged such that the distal ends are on either side of the respective first member; a reverse-drivable magnet-latching solenoid having a first drive coil drivable to open and close the movable and fixed electrical contacts, and a second non-drive coil feedback connected to induce a reverse flux to temper and stabilize a net flux, thereby enabling control of a delay time of the opening and closing electrical contacts so as to be at or adjacent to a zero-crossing of an associated AC load current; and at least one moveable member associated with a plunger of the reverse-drivable magnet-latching solenoid, for providing an actuation each pair of moveable arms.

Preferably, there is a driving circuit in electrical communication with at least the first drive coil of the AC dual-coil actuator.

Preferably, the driving circuit supplies a drive pulse to the first drive coil having a half-cycle waveform profile. More preferably, the drive pulse has a quarter-cycle waveform profile.

According to a third aspect of the invention, there is provided a method of controlling electrical contact closing and opening delay, the method comprising the steps of driving a first coil of an AC dual-coil actuator to open and close electrical contacts of an electrical contactor, and inducing a reverse flux through feedback connection in a second coil to temper and stabilize a net flux in the actuator, thereby controlling a delay time of the opening and closing electrical contacts.

Preferably, the first coil of the AC dual-coil actuator is energized with half-cycle waveform drive pulses to reduce or limit erosion energy applied between contacts. More preferably, the first coil of the AC dual-coil actuator is energized with quarter-cycle waveform drive pulses to prevent contact separation prior to peak load current.

According to a fourth aspect of the invention, there is provided a method of limiting or preventing electrical contact bounce and arc duration, the method comprising the steps of driving a first coil of an AC dual-coil actuator to open and close electrical contacts of an electrical contactor, and inducing a reverse flux through feedback connection in a second coil to temper and stabilize a net flux in the actuator, thereby controlling a delay time of the opening and closing electrical contacts so as to be at or adjacent to a zero-crossing of an associated AC load current.

Preferably, the first coil of the AC dual-coil actuator is energized with half-cycle waveform drive pulses to reduce or limit erosion energy applied between contacts. More preferably, the first coil of the AC dual-coil actuator is energized with quarter-cycle waveform drive pulses to prevent contact separation prior to peak load current.

According to a fifth aspect of the invention, there is provided a method of limiting or preventing electrical contact bounce and arc duration, the method comprising the step of driving an electrical actuator to open and close electrical contacts of an electrical contactor, a drive pulse being applied to drive the electrical actuator having a truncated-waveform.

Preferably, the truncated-waveform is based on a peak load current.

Controlling the opening and closing delay of the electrical contactor and limiting or preventing the electrical contact bounce, preferably utilizing a drive pulse having a truncated waveform allows the lifetime of the contacts to be extended, by limiting the damage caused to the contacts by erosion energy and arcing.

BRIEF DESCRIPTION OF THE DRAWINGS

Preferred embodiments of the invention will now be described, by way of example only, with reference to figures of the accompanying drawings. In the figures, identical structures, elements or parts that appear in more than one figure are generally labeled with a same reference numeral in all the figures in which they appear. Dimensions of components and features shown in the figures are generally chosen for convenience and clarity of presentation and are not necessarily shown to scale. The figures are listed below.

DETAILED DESCRIPTION OF THE PREFERRED EMBODIMENTS

Figure 1:
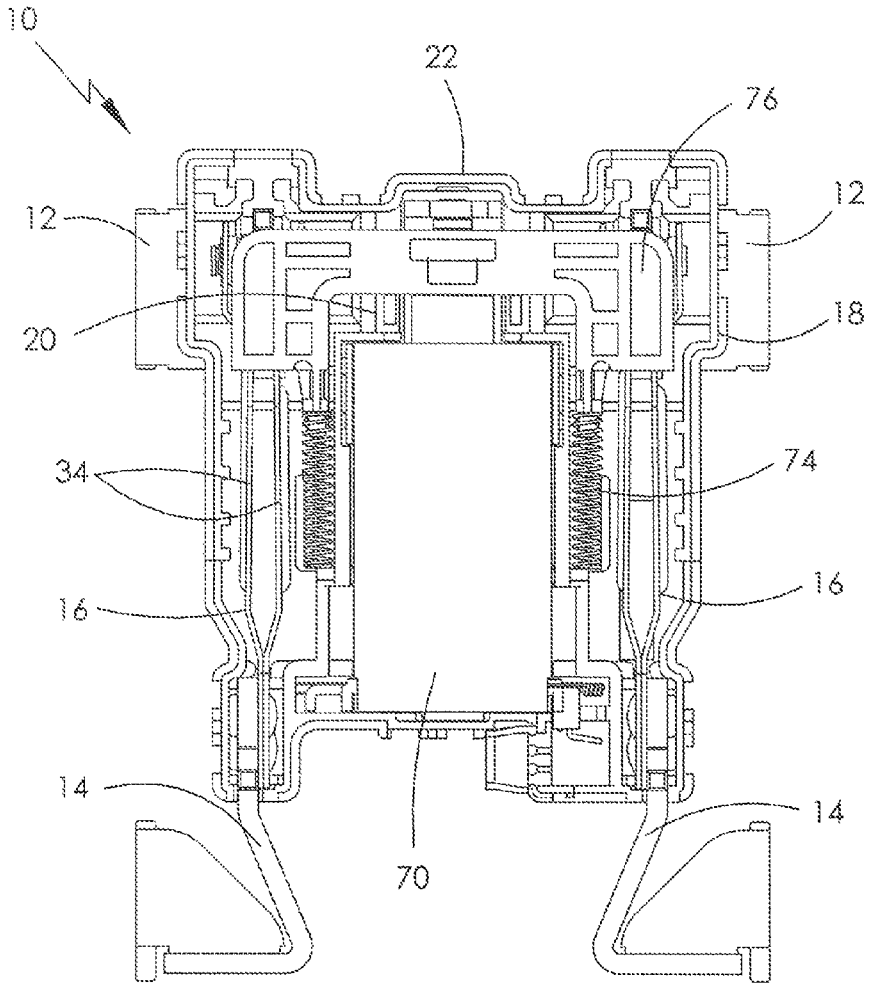
FIG. 1 shows a top plan view of a first embodiment of an electrical contactor, with a housing cover removed and according to the first aspect of the invention.
Figure 2:
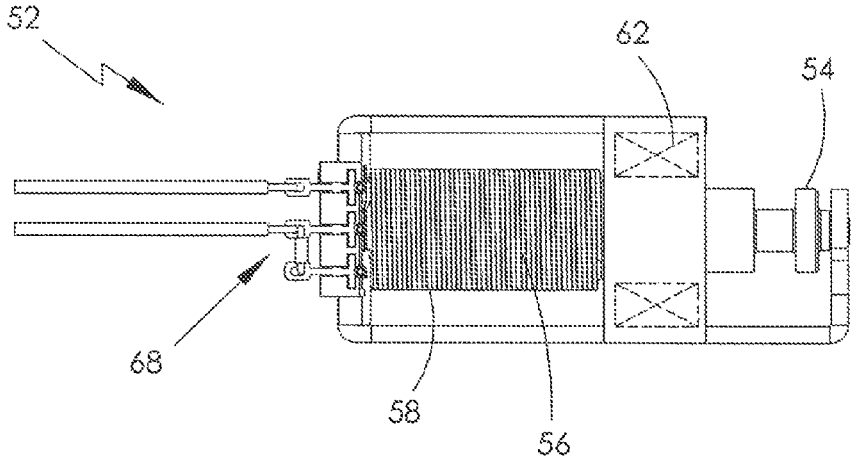
FIG. 2 shows a side view of a reverse-drivable solenoid of the electrical contactor shown in FIG. 1.

Referring firstly to FIGS. 1 to 4 of the drawings, there is shown a first embodiment of an electrical contactor, globally shown at 10 and in this case being a two-pole device, which comprises two outlet terminals 12, two feed terminals 14, and two pairs of movable arms 16.

The outlet terminals 12 and feed terminals 14 extend from a contactor housing 18, and are mounted to a housing base 20 and/or an upstanding perimeter wall 22 of the contactor housing 18. The housing cover is not shown for clarity.

Each outlet terminal 12 includes a first terminal pad 24 and a fixed, preferably electrically-conductive, first member 26 which extends from the first terminal pad 24 into the contactor housing 18. At least one, and in this case two, fixed electrical contacts 28 are provided at or adjacent to a distal end of each first member 26. In this instance, the fixed electrical contacts 28 are provided on opposing faces of the distal end of the fixed member 26, the contacts 28 preferably having a domed profile.

Each feed terminal 14 is paired with a respective outlet terminal 12 to form a terminal pair. Each feed terminal 14, which is spaced from its respective outlet terminal 12, includes a second terminal pad 30 which extends from the contactor housing 18.

Each pair of movable arms 16 are engaged with a fixed, electrically conductive, second member 32 to the respective feed terminals 14. Engagement may take any suitable form, providing electrical communication is facilitated between the pair of movable arms 16 and the feed terminal 14. For example, welding, brazing, riveting or even bonding may be utilized.

Figures 3, 4:
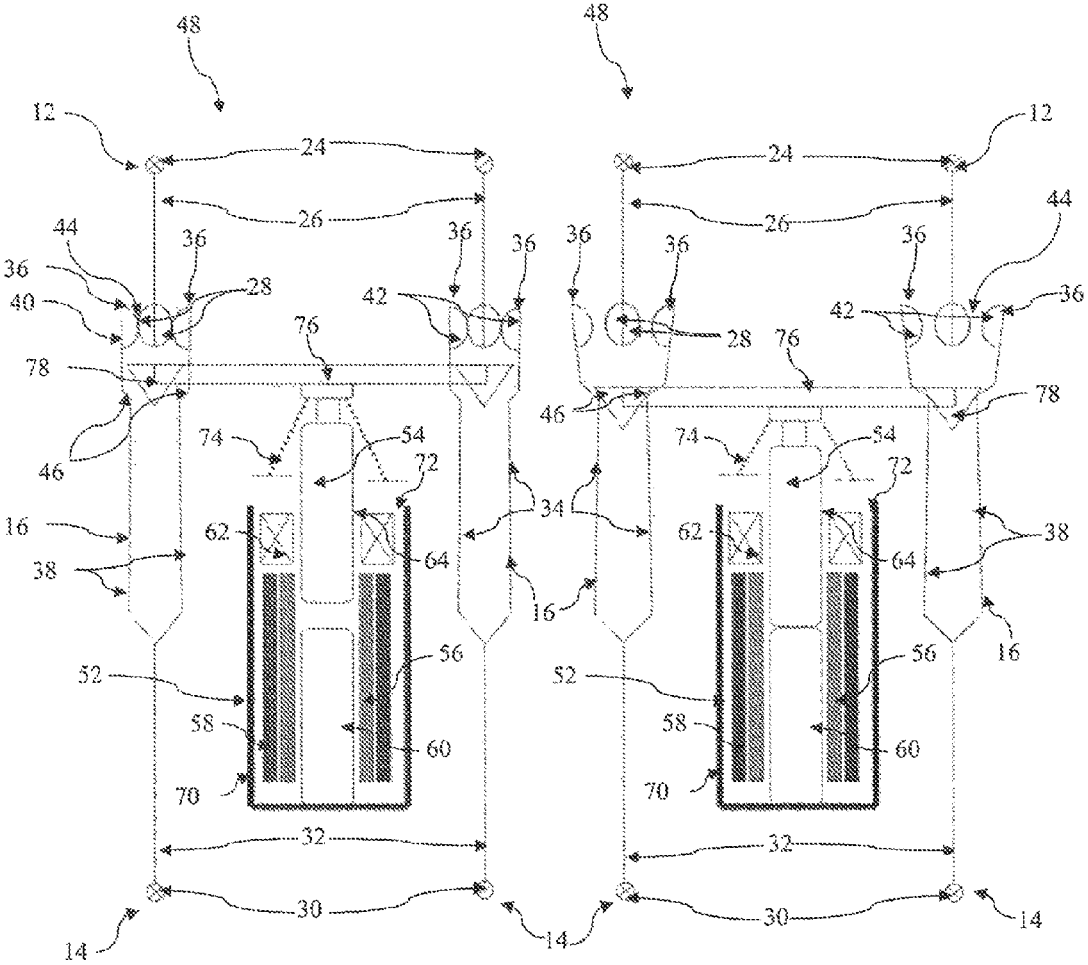
FIG. 3 shows a schematic view of a 2-pole electrical contactor according to the first aspect of the invention, the contactor being in the contacts closed position.
FIG. 4 shows a schematic view of a 2-pole electrical contactor according to the first aspect of the invention, the contactor being in the contacts open position.

With reference to FIGS. 1 and 3, each moveable arm 34 of the pair of moveable arms 16 extends from the second member 32 such that the free distal ends 36 of the moveable arms 34 are separated from one another. Each movable arm 34 comprises a body portion 38 which terminates with a head portion 40 at which is located a movable electrical contact 42, also preferably having a domed profile. Each moveable electrical contact 42 is associated with a corresponding fixed electrical contact 28 to form a contact pair 44.

As part of the body 38 of each moveable arm 34, there is provided a bent portion 46 to further separate the distal ends 36 of the moveable arms 34 from one another. The bent portion 46 enables the majority of the body 38 of each moveable arm 34 within a pair 16 to be relatively closely spaced, whilst keeping the head portions 40 and therefore moveable contacts 42 sufficiently apart from one another.

It is preferable that the head portions 40 of the two movable arms 34 in a moveable arm pair 16 are parallel or substantially parallel to one another, so that a common or uniform predetermined gap is provided between the movable arms 34, into which can be positioned the fixed electrical contacts 28 attached to each first member 26.

It will be appreciated that in some instances the movable arms 34 may not necessarily be formed of electrically conductive material, such as copper for example. In this case, the movable electrical contacts 42 may be fed by or feed separate electrical conductors, such as a wire or cable.

It is important that the contacts used have adequate top-lay silver-alloy thickness in order to withstand the arduous switching and carrying duties involved, thus reducing contact wear. Prior art electrical contacts of an 8 mm diameter bi-metal have a silver-alloy top-lay thickness in a range 0.65 mm to 1.0 mm. This results in a considerable silver cost.

To address the issue of tack welding between contacts under high short-circuit loads, a particular compound top-lay can be utilized, in this case enriching the silver alloy matrix with a tungsten-oxide additive. Addition of the tungsten-oxide additive in the top-lay matrix has a number of important effects and advantages, amongst which are that it creates a more homogeneous top-lay structure, puddling the eroding surface more evenly, but not creating as many silver-rich areas, thus limiting or preventing tack-welding. The tungsten-oxide additive raises the general melt-pool temperature at the switching point, which again discourages tack-welding, and due to the tungsten-oxide additive being a reasonable proportion of the total top-lay mass, for a given thickness, its use provides a cost saving.

To assist in damping an opening and closing process of the movable and fixed electrical contacts 42, 28, the two movable arms 34 are preformed and preloaded such that the head 40 is naturally biased towards its respective fixed electrical contact 28.

To control the movable electrical contact set, described above and globally referenced as 48, an actuator arrangement 50 is utilized which comprises in this case a reverse driven, magnet-latching solenoid 52, having a linearly slidable plunger 54 acting as the actuator.

The solenoid 52 comprises first and second coils 56, 58 wrapped in tight helices about a solid stationary core 60, the plunger 54, being aligned with the core 60 and actuatable along the longitudinal axis of the coils 56, 58, and a permanent magnet 62 disposed at a plunger end 64 of the solenoid 52 for latching the plunger 54 into advanced and withdrawn states, thereby reducing the energy requirement of the solenoid 52. In this case, the first coil 56 is in connection with driving circuitry 66, whereas the second coil 58 is non-driven, and only in connection with the AC+ common center connection 68 of the solenoid 52. Both coils are formed from an electrically conductive material, such as copper wire.

The solenoid 52 is contained within an actuator housing 70, having an opening 72 at one end to allow for the displacement of the plunger 54. There is further preferably provided at least one spring element 74 connected at one end to the actuator housing 70 and at the other to a protruding end 68 of the plunger 54. The spring element 74 biases the plunger 54 to its advanced position.

Figure 6:
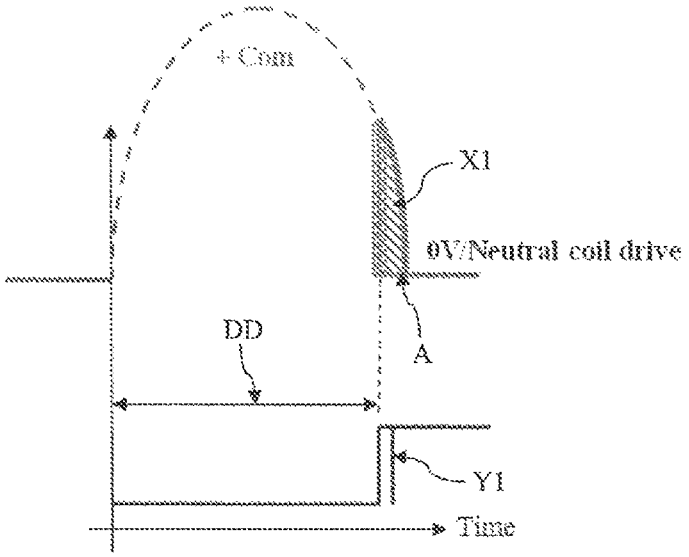
FIG. 6 graphically represents the additional control over the closing of the contacts provided by the electrical contactor.
Figure 8:
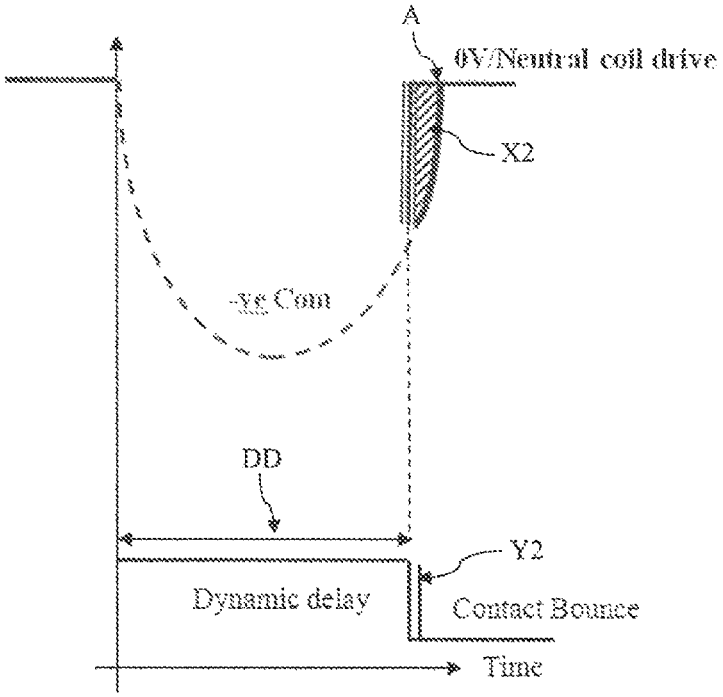
FIG. 8, similarly to FIG. 5, graphically represents the additional control over the opening of the contacts provided by the electrical contactor.

In this embodiment, to improve a balance of the opening (release) and closing (operate) processes of the movable and fixed electrical contacts 42, 28, as well as reducing the deleterious effects of arcing and contact bounce, the AC coil drive circuitry 66 is configured such that switching of the drive coil is synchronized or more closely aligned with an AC load waveform zero-crossing point, referenced as A in FIGS. 6 and 8.

To this end, the actuator arrangement 50 is adapted so that only the first coil 56 of the solenoid 52 may be AC pulse driven in one polarity to advance the plunger 54, and then AC pulse driven with a reversed polarity to withdraw the plunger 54.

The non-driven or non-energized second coil 58 of the solenoid 52 is feedback connected to the original AC+ common center connection 68 of the solenoid 52.

To control the movable arms 34, the plunger 54 is attached to a slidable carriage 76, which is in turn connected to an urging device 78 for each of the pairs of moveable arms 16. The slidable carriage 76 in this case may be an overhanging platform, and the urging devices 78 may be wedge-shaped members which can be moved so as to press against or release the bent portion 46 of the body 38 of each moveable arm 34 to provide an actuation, either opening or closing the corresponding contact pair 44.

It will be appreciated that the urging device may take other alternative forms, for instance, a leaf spring for directly urging the moveable arms 34.

In operation, the plunger 54 is advanced to its, first contacts-closed, magnetically-latched state, as shown in FIG. 3. Operation of the plunger 54 moves the wedge-shaped members 78 to their advanced position, releasing the pressure applied to the bent portion 46 of the body 38 of each moveable arm 34. Since each moveable arm 34 within a moveable arm pair 16 is preloaded towards the other, the head portions 40 will move towards one another, and the moveable contacts 42 will come into contact with the fixed contacts 28, closing the contact pair 44.

Figure 5:
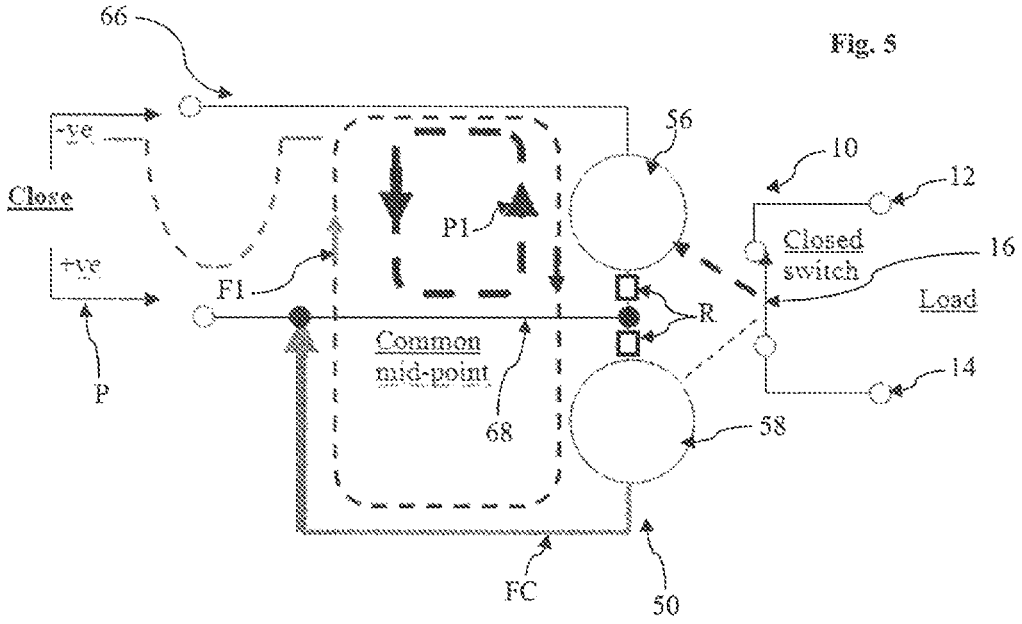
FIG. 5 is a generalized circuit diagram of the electrical contactor, showing an actuator with feedback connection being driven to close the contacts.

As mentioned above, by energizing only the first coil 56 of the solenoid 52 with a first polarity P1 and with the second coil 58 feedback connected, as shown in FIG. 5, a reverse flux, F1, can be induced via the feedback connection FC in the second coil 58 thereby tempering and feedback stabilizing a net flux in the solenoid 52. This allows the contact closing time DD to be controlled and therefore shifted to or adjacent to the AC load waveform zero-crossing point A, as shown in FIG. 6.

As a consequence, and as can be understood from FIG. 6, by carefully matching the coils, the strength of the feedback connection, and therefore the controlled delay of the closing of the movable and fixed electrical contacts 42, 28, arcing and thus contact erosion energy is reduced or eliminated, shown by hatched portion X1 in FIG. 6, prolonging contact life or improving endurance life. Possible contact bounce, referenced at Y1, is also shifted to or much closer to the zero-crossing point, referenced at A, again improving contact longevity and robustness during closing.

In the contacts-closed condition, as can be appreciated from FIG. 3, the movable arms 34 and thus moveable contacts 42, in the absence of a separating force, are naturally closed with respect to the corresponding fixed electrical contacts 28, under the preloaded biasing force. The contacts-closed condition is achieved when the plunger 54 is in an advanced position.

Upon withdrawal of the plunger 54, the slidable carriage 76 will be actuated such that the wedge-shaped member 78 is disposed between the two moveable arms 34 of a moveable arm pair 16, applying a force to the bent portions 46 of the bodies 38. This will separate the moveable anus 34 and breaking the contact between the contact pair 44.

The breaking of the contact between the contact pair 44 occurs on the withdrawal of the plunger 54. Since the solenoid 52 is reverse-driven, the withdrawal is a much more powerful action than the advancement of the plunger 54, thereby providing a much greater force to break the contact, should the contact pair 44 have tack welded.

Figure 7:
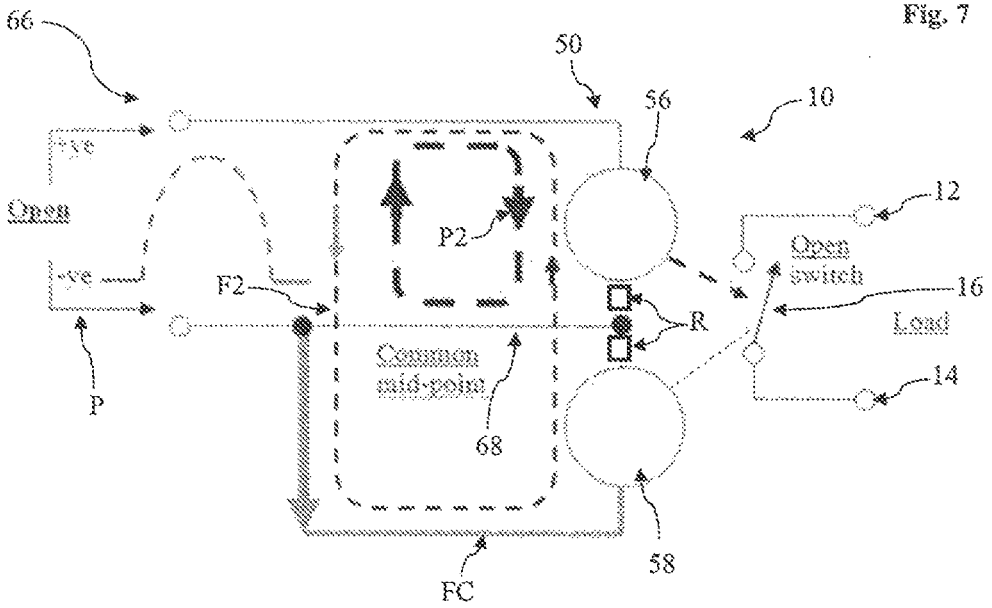
FIG. 7 is a generalized circuit diagram of the electrical contactor, similar to that of FIG. 5 and showing the actuator with feedback connection being driven to open the contacts.

As with the closing or operating process, by reverse driving only the first drive coil 56 of the solenoid 52 with a reverse polarity P2 and with the second non-driven coil 58 feedback connected, as shown in FIG. 7, a reverse flux F2 can be induced via the feedback connection FC in the second coil 58 thereby tempering and feedback stabilizing a net flux in the solenoid 52. This allows the contact opening time DD to be controlled and therefore shifted to or adjacent to the AC load waveform zero-crossing point A, as shown in FIG. 8.

Therefore, again and as can be understood from FIG. 8, by carefully matching the coils, the strength of the feedback connection, and therefore the controlled delay of the opening of the movable and fixed electrical contacts 42, 28, arcing and thus contact erosion energy is reduced or eliminated, shown by hatched portion X2 in FIG. 8, prolonging contact life or improving endurance life. Possible contact bounce, referenced at Y2, is also shifted to or much closer to the zero-crossing point A, again improving contact longevity and robustness during opening.

By way of example, a standard or traditional contact opening and closing time may include a dynamic delay of 5 to 6 milliseconds, primarily due to the time taken to delatch the magnetically-retained plunger 54. By using the control of the present invention, this dynamic delay is fractionally extended to 7 to 8 milliseconds to coincide more closely or synchronize with the next or subsequent zero-crossing point of the AC load waveform.

Typically, the drive pulse applied to the first coil 56 will have a positive half-cycle waveform to close the contacts 42, 28, and a negative half-cycle waveform to open the contacts 42, 28. Synchronization or substantial synchronization of the dynamic delay DD with the zero-crossing point A will reduce arcing and contact erosion energy.

If the contactor 10 is used over a wide range of supply voltages, the dynamic delay DD can vary greatly between the different voltages. The higher the supply voltage, the more rapid the actuation of the plunger 54. As a result, with a half-cycle drive pulse, there is a possibility of a very short dynamic delay DD, which may lead to contact closure occurring at or before the peak load current.

Figure 9:
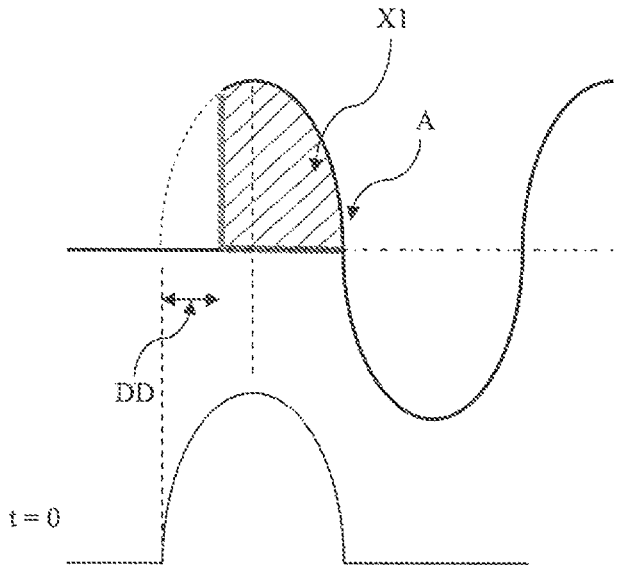
FIG. 9 graphically represents the additional control over preferably the closing of the contacts as driven by a half-cycle drive pulse.
Figure 10:
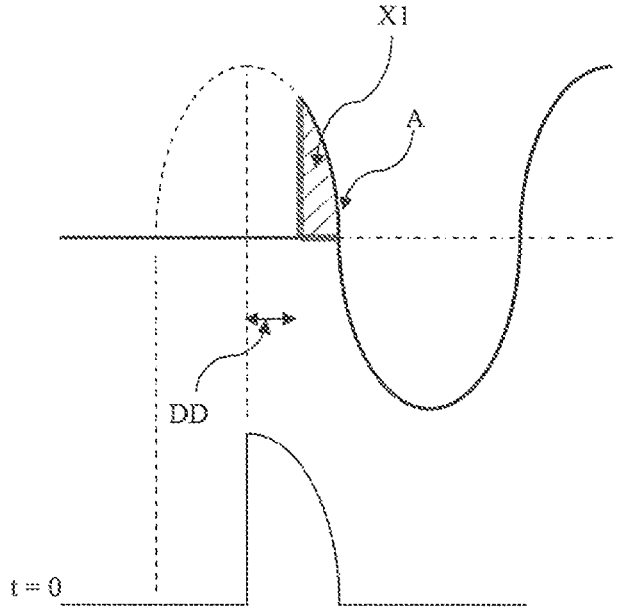
FIG. 10, similarly to FIG. 8, graphically represents the additional control over preferably the closing of the contact as driven by a quarter-cycle drive pulse.

As shown in FIGS. 9 and 10, the dynamic delay DD is short due to a high or higher AC supply voltage. The subsequent contact erosion energy X1 is thus very large. This large contact erosion energy X1 may damage the contacts 42, 28, lessening their lifespans.

The contact erosion energy X1 can be further reduced by using an AC supply which energizes the first coil 56 with a truncated drive pulse, in this case preferably being a quarter-cycle drive pulse as shown in FIG. 10, in place of the half-cycle drive pulse, shown in FIG. 9. In this arrangement, the quarter-cycle drive pulse will not trigger and thus drive the first coil 56 until the peak load current is reached. As such, this can be considered a 'delayed' driving approach. As will be appreciated, the use of a truncated-waveform drive pulse may be utilized with or without the non-driven second coil 58 of the solenoid 52 being feedback connected to the original AC+ common center connection 68 of the solenoid 52. As such, the use of a truncated-waveform drive pulse which preferably coincides with the peak load current may be utilized with any electrical actuator, for example, a single coil or a dual-coil actuator, in order to better control contact bounce, arc duration, and/or opening and closing delay or electrical contacts.

By triggering the truncated-cycle, being in this case a quarter-cycle, drive pulse on the peak load current, the closing of the contacts 42, 28 can never occur prior to the peak load current. However, by utilizing a control circuit as part of the power supply P outputting to the electrical actuator, a degree of truncation of the current waveform on the time axis can be carefully selected and optimized based on the peak load current, the required contact opening and closing force and delay, and the arc and/or erosion energy imparted to the contacts during the contact opening and closing procedures. As such, although a quarter-cycle drive pulse is preferred, since this coincides with the peak load current, it may be beneficial for a controller outputting an energisation current to the actuator to be set to truncate the waveform of the drive pulse to be prior or subsequent to the peak load current.

The truncated-waveform drive pulse may be AC or DC.

The dynamic delay DD is still preferably configured to synchronize or substantially synchronize with the zero-crossing point A, thereby minimizing the contact erosion energy X1 even further. However, when utilized together with the controlled truncated waveform of the drive pulse, this is achieved in a more controlled manner than with the half-cycle drive pulse.

The American National Standards Institute (ANSI) requirements are particularly demanding for nominal currents up to 200 Amps. The short-circuit current is 12 K.Amp rms, but for a longer withstand duration of four full Load cycles, with 'safe' welding allowable. Furthermore, a "moderate" short-circuit current level of 5 K.Amps rms requirement may hold, wherein the contacts must not tack-weld over six full Load cycles.

The above embodiments benefit from the actuator arrangement 50 which utilizes only the first drive coil 56 energized in two polarities to advance and withdraw the plunger 54 along with the feedback connected non-driven coil 58. However, benefits can still be obtained by utilizing the solenoid 52 in which one coil is, preferably negatively, AC driven to advance the plunger 54 whilst the other coil is, preferably negatively, AC driven to retract the plunger 54. In this regard, the solenoid 52 is driven via a series resistor R to the positive common midpoint.

Whilst the above invention has been described as having a reverse-drivable solenoid having a plunger in communication with moveable wedge-shaped members acting as an actuator, it will be appreciated that any suitable actuation means could be provided as part of the solenoid, for instance a rotary H-armature actuator.

It will also be appreciated that whilst the present embodiment of the invention is described as being a 2-pole contactor, an actuator in the form of a reverse-drivable magnet-latching solenoid, in particular as driven by a truncated-waveform driving pulse can be applied to a variety of electrical contactors, having different quantities or designs of moveable arms.

For instance, a bi-bladed contactor configuration could be utilized. Such a configuration may be particularly useful. In particular, it has been shown that the "moderate" short-circuit withstand level, wherein the contacts must not tack-weld over six full Load cycles, is effective even up to 12 K.Amps rms for such a configuration utilized in conjunction with the present invention.

It is therefore possible to provide an electrical contactor having at least one electrical contact pair, the opening and closing of said electrical contact pair being controlled by an AC actuator, especially in the form of a reverse-drivable magnet latching solenoid.

The reverse-drivable magnet latching solenoid may be configured to have a first driven coil and a second non-driven coil, a reverse flux being induced in the second coil through a feedback connection to temper and stabilize a net flux in the solenoid. This allows the delay time of the opening and closing of the electrical contact pair to be controlled, so as to be adjacent to a zero-crossing of an associated AC load current, thereby limiting or preventing electrical contact bounce in the contactor.

This design may be further improved by energizing the first coil of the solenoid with half- or quarter-cycle waveform drive pulses, thereby limiting the possible contact erosion energy on switching.

The words 'comprises/comprising' and the words 'having/including' when used herein with reference to the present invention are used to specify the presence of stated features, integers, steps or components, but do not preclude the presence or addition of one or more other features, integers, steps, components or groups thereof.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The embodiments described above are provided by way of examples only, and various other modifications will be apparent to persons skilled in the field without departing from the scope of the invention as defined herein.

The invention claimed is:

1. An electrical contactor comprising:

a first terminal having a fixed member with at least one fixed electrical contact;

a second terminal;

at least one electrically-conductive movable arm in electrical communication with the second terminal and having a movable electrical contact thereon; and an AC dual-coil actuator having a first drive coil drivable to open and close the movable and fixed electrical contacts, and a second non-drive coil feedback directly connected to an AC±common center of the AC dual-coil actuator to induce a reverse flux to temper and stabilise a nett flux, thereby enabling control of a delay time of the opening and closing electrical contacts so as to be at or adjacent to a zero-crossing of an associated AC load current.

2. The electrical contactor of claim 1, wherein the driving of the first drive coil induces a reverse flux through feedback connection in the second non-drive coil to temper and stabilise a nett flux, thereby controlling a delay time of the opening and closing of the first and second electrical contacts.

3. The electrical contactor of claim 1, wherein the AC dual-coil actuator is a magnet-latching solenoid actuator, the magnet-latching solenoid actuator including a plunger.

4. The electrical contactor of claim 3, wherein the magnet-latching solenoid is reverse drivable.

5. The electrical contactor of claim 4, comprising at least one biasing spring for biasing the plunger to a contacts closed position.

6. The electrical contactor of claim 1, further comprising a driving circuit in electrical communication with at least the first drive coil of the AC dual-coil actuator.

7. The electrical contactor of claim 6, wherein the driving circuit supplies a drive pulse to the first drive coil having a half-cycle waveform profile.

8. The electrical contactor of claim 6, wherein the driving circuit supplies a drive pulse to the first drive coil having a quarter-cycle waveform profile.

9. A two-pole electrical contactor comprising:

two feed terminals and two outlet terminals, each outlet terminal being connected to a pair of contacts on opposite faces of an electrically-conductive first member;

two pairs of moveable arms, one pair of moveable arms being clamped at one end to one feed terminal, and the other pair of moveable arms being clamped at one end to the other terminal, each arm carrying a moveable contact at a distal end of the arm from the feed terminal, the moveable arms being arranged such that the distal ends are on either side of the respective first member;

a reverse-drivable magnet-latching solenoid having a first drive coil drivable to open and close the movable and fixed electrical contacts, and a second non-drive coil feedback directly connected to an AC± common center of the AC dual-coil actuator to induce a reverse flux to temper and stabilise a nett flux, thereby enabling control of a delay time of the opening and closing electrical contacts so as to be at or adjacent to a zero-crossing of an associated AC load current; and at least one moveable member associated with a plunger of the reverse-drivable magnet-latching solenoid, for providing an actuation each pair of moveable arms.

10. The electrical contactor of claim 9, wherein there is further provided a driving circuit in electrical communication with at least the first drive coil of the AC dual-coil actuator.

11. The electrical contactor of claim 10, wherein the driving circuit supplies a drive pulse to the first drive coil having a half-cycle waveform profile.

12. The electrical contactor of claim 10, wherein the driving circuit supplies a drive pulse to the first drive coil having a quarter-cycle waveform profile.

13. A method of controlling electrical contact closing and opening delay, the method comprising the steps of driving a first coil of an AC dual-coil actuator to open and close electrical contacts of an electrical contactor, and inducing a reverse flux through feedback connection in a second coil which is feedback directly connected to an AC± common center of the AC dual-coil actuator to temper and stabilise a nett flux in the actuator, thereby controlling a delay time of the opening and closing electrical contacts.

14. The method of claim 13, wherein the first coil of the AC dual-coil actuator is energised with half-cycle waveform drive pulses to reduce or limit erosion energy applied between contacts.

15. The method of claim 14, wherein the first coil of the AC dual-coil actuator is energised with quarter-cycle waveform drive pulses to prevent contact separation prior to peak load current.

16. A method of limiting or preventing electrical contact bounce and arc duration, the method comprising the steps of driving a first coil of an AC dual-coil actuator to open and close electrical contacts of an electrical contactor, and inducing a reverse flux through feedback connection in a second coil which is feedback directly connected to an AC± common center of the AC dual-coil actuator to temper and stabilise a nett flux in the actuator, thereby controlling a delay time of the opening and closing electrical contacts so as to be at or adjacent to a zero-crossing of an associated AC load current.

17. The method of claim 16, wherein the first coil of the AC dual-coil actuator is energised with half-cycle waveform drive pulses to reduce or limit erosion energy applied between contacts.

18. The method of claim 16, wherein the first coil of the AC dual-coil actuator is energised with quarter-cycle waveform drive pulses to prevent contact separation prior to peak load current.

19. A method of limiting or preventing electrical contact bounce and arc duration, the method comprising the step of driving an electrical actuator to open and close electrical contacts of an electrical contactor, a drive pulse being applied to drive the electrical actuator having a truncated-waveform.

20. The method of claim 19, wherein the truncated-waveform is based on a peak load current.

* * * * *